US008875431B2

(12) United States Patent
Prayias

(10) Patent No.: US 8,875,431 B2
(45) Date of Patent: Nov. 4, 2014

(54) ARTWORK PRESERVATION SYSTEM

(71) Applicant: John Prayias, Palm Beach, FL (US)

(72) Inventor: John Prayias, Palm Beach, FL (US)

( * ) Notice: Subject to any disclaimer, the term of this patent is extended or adjusted under 35 U.S.C. 154(b) by 0 days.

(21) Appl. No.: 13/972,383

(22) Filed: Aug. 21, 2013

(65) Prior Publication Data

US 2014/0053443 A1 Feb. 27, 2014

Related U.S. Application Data

(60) Provisional application No. 61/691,527, filed on Aug. 21, 2012.

(51) Int. Cl.
*A47G 1/06* (2006.01)
*B44D 7/00* (2006.01)

(52) U.S. Cl.
CPC ... *A47G 1/06* (2013.01); *B44D 7/00* (2013.01)
USPC ..... 40/781; 40/725; 206/524.8

(58) Field of Classification Search
USPC ..... 40/781, 700, 718, 725; 206/524.8
See application file for complete search history.

(56) References Cited

U.S. PATENT DOCUMENTS

| | | | | |
|---|---|---|---|---|
| 1,031,727 | A | 7/1912 | Mussbeck | |
| 3,613,879 | A * | 10/1971 | Kemble | 206/210 |
| 3,655,034 | A | 4/1972 | Stollman et al. | |
| 5,555,938 | A * | 9/1996 | Tzeng | 169/36 |
| 5,918,393 | A * | 7/1999 | Martell | 40/1 |
| 2002/0056656 | A1 | 5/2002 | Beliveau | |
| 2006/0130430 | A1 * | 6/2006 | Akatsuka et al. | 53/433 |
| 2007/0017846 | A1 * | 1/2007 | Kiyoo | 206/524.8 |
| 2008/0230429 | A1 * | 9/2008 | Anderson | 206/524.8 |
| 2009/0050512 | A1 * | 2/2009 | Pham | 206/524.8 |
| 2009/0178321 | A1 * | 7/2009 | Kucharski | 40/700 |
| 2009/0290817 | A1 | 11/2009 | Borchardt | |
| 2010/0077688 | A1 * | 4/2010 | Bowen | 52/506.09 |
| 2011/0138744 | A1 * | 6/2011 | Newrones et al. | 53/405 |
| 2012/0181210 | A1 * | 7/2012 | Shi | 206/524.8 |
| 2012/0318702 | A1 * | 12/2012 | Shi | 206/524.8 |
| 2013/0160339 | A1 * | 6/2013 | Glennon | 40/757 |

FOREIGN PATENT DOCUMENTS

| | | |
|---|---|---|
| GB | 2335695 | 9/1999 |

OTHER PUBLICATIONS

Briot, A. "Packing and shipping your photographs framed or unframed", Nature Photographers Online Magazine, Retrieved from the Internet Nov. 14, 2013: http://www.naturephotographers.net/articles0810/ab0810-1.pdf, XP055088258, (Jul. 31, 2010).

Shenton, H., "The use of vacuum packing in Australia", Victoria and Albert Museum Conservation Journal, No. 9, XP055088124, (Oct. 1, 1993).

* cited by examiner

*Primary Examiner* — Gary Hoge
(74) *Attorney, Agent, or Firm* — McHale & Slavin, P.A.

(57) ABSTRACT

The present invention relates to artwork preservation, and more particularly to an artwork preservation system that utilizes vacuum and is particularly suited to framed artwork. The artwork preservation system includes: a pair of corrugated planar members constructed and arranged to overlap a front side and back side of an artwork; at least one securing element, such as hook and loop fastener, for mating the first and second corrugated boards when the artwork is placed there between; a layer of air cushioning; and a sealable bag. The system may further include a vacuum pump for removing air from the sealable bag.

13 Claims, 4 Drawing Sheets

ARTWORK PRESERVATION SYSTEM

REFERENCE TO RELATED APPLICATION

In accordance with 37 C.F.R 1.76, a claim of priority is included in an Application Data Sheet filed concurrently herewith. Accordingly, the present invention claims priority under 35 U.S.C. §119(e) to U.S. Provisional Application 61/691,527 entitled "ARTWORK PRESERVATION SYSTEM" filed on Aug. 21, 2012. The contents of each of the above referenced applications are herein incorporated by reference in its entirety.

FIELD OF THE INVENTION

The present invention relates to art conservation; more specifically, the preservation of framed artwork using a sealable bag being operatively compatible with an external vacuum machine.

BACKGROUND OF THE INVENTION

Art conservation is a profession devoted to the preservation of cultural heritage for the future. Many cultural works are sensitive to environmental conditions such as temperature, humidity, and exposure to light. They must be protected in a controlled environment where such variables are maintained within a range of damage-limiting levels. A conservator is typically employed to do so. The traditional definition of the role of the conservator involves the examination, conservation, and preservation of cultural heritage using "any methods that prove effective in keeping that property in as close to its original condition as possible, for as long as possible." However, today the definition of the role of conservator has widened and would more accurately be described as that of an ethical stewardship. The conservator applies some simple ethical guidelines such as minimal intervention, the use of appropriate materials and methods that aim to be reversible to reduce possible problems with future treatment, investigation, and full documentation of all work undertaken. In order to maintain the ethical guidelines set forth, a conservator should employ methods and materials to ensure that the framed artwork is protected from harmful environmental factors while not compromising its condition or integrity. Furthermore, no process used by the conservator should be irreversible. Additionally, the conservator must take into account several environmental factors, such as light, heat, humidity, moisture, dirt, and dust, as they can be harmful to artwork. Any amount of light is damaging to artwork over time. Colors will fade as a result of exposure to ultraviolet rays from natural and fluorescent sources alike. Paper absorbs high-energy photons which, through a chemical reaction, break down the paper over time cause it to become brittle. Warm and moist conditions invite the growth of mold and bacteria. Framed artwork should be kept away from sources of heat or water. Moisture in the form of condensation can collect inside the framing if subjected to radical changes in temperature or humidity. Pollution in the atmosphere can combine with moisture in the air to form acids that will cause damage to works on paper.

However, art owners are often not skilled in art preservation and may need to store, transport or protect their art collection. This is especially true in coastal areas where extreme storms and hurricanes can occur. In these areas, large amounts of art must be protected and/or transported from the storm area to a safe storage area before a storm arrives. Afterwards, the art must be transported a second time for return to its origin. This situation leaves the art owner with the need to hire a professional or move the art themselves. Often due to the volume of art that must be moved, professionals are unavailable to complete the work. Leaving the owner to pack the artwork into wooden crates or cardboard boxes with pieces of Styrofoam for transport or storage. During transport or storage the artwork may be subjected to high humidity and heat, vibration, rain and rough handling. This, in addition to the chemicals present in the packing materials, may cause damage to the artwork.

Vacuum packaging is a method of packaging often utilized by the food industry, which removes air from the package prior to sealing. It can involve both rigid and flexible types of packaging. The intent is usually to remove oxygen from the container to extend the shelf life of the article within. Vacuum packing reduces atmospheric oxygen, limiting the growth of aerobic bacteria or fungi, and prevents the evaporation of volatile components. External vacuum sealers typically involve a bag being attached to a vacuum pump or placed within a vacuum atmosphere. The machine will remove the air and seal the container to resist vacuum loss.

The advantages to vacuum packing appear to be consistent with the needs of a conservator for the conservation of artwork. However, any vacuum packing arrangement for artwork must overcome a few issues to be accepted by an end user. First, an airtight seal does nothing to protect the art from changes in temperature, and the art may not expand or contract properly with the temperature changes if it is improperly packaged before being vacuum-sealed. Symptoms of poor expansion and contraction include buckling and warping. Also, if an adhesive is used anywhere in the vacuum packaging (as in the tape or rice hinges used to attach the art to the substrate), extreme heat or cold can change the efficacy of the adhesive and cause it to release. Another issue relates to trapping bacteria, mold, moisture, or other foreign substances that may already be on the art to begin with.

Thus, what is lacking in the art is a framed artwork preservation system incorporating a sealable bag, operatively compatible with an external vacuum pump that not only allows for proper ventilation but also indicates various levels of humidity and atmospheric pressure within the sealed bag. The construction of the artwork preservation system should allow for expansion and contraction of the artwork stored therein. The artwork preservation system should also resist bacteria and mold growth. Still, the artwork preservation system should provide cushioned protection to the artwork to prevent or reduce damage from inadvertent handling.

SUMMARY OF THE INVENTION

The present invention relates to artwork preservation, and more particularly to an artwork preservation system that utilizes vacuum and is particularly suited to framed artwork. The artwork preservation system includes: a pair of corrugated planar members constructed and arranged to overlap a front side and back side of an artwork; at least one securing element, such as hook and loop fastener, for mating the first and second corrugated boards when the artwork is placed there between; a layer of air cushioning; and a sealable bag. The system may further include a vacuum pump for removing air from the sealable bag. The sealable bag has an interior and exterior surface, an opening, a port, a vacuum pressure indicator, and a humidity indicator. The bag opening is large enough to accommodate the pair of corrugated boards with an artwork placed in between, and includes a zip type fastener for the sealing thereof. A port is in fluid communication with the interior and exterior surfaces of the sealable bag, and includes an orifice which is operatively compatible with the vacuum pump for drawing out atmospheric pressure within the interior of the sealable bag. The humidity indicator senses and readily discloses the level of humidity within the sealable bag. The vacuum indicator gives a visual indication of the loss or presence of vacuum within the sealable bag. The framed artwork preservation system stores the artwork within, allows for proper ventilation within, and indicates various levels of humidity and pressure within.

Accordingly, it is an objective of the present invention to provide an artwork preservation system that protects the artwork from the impact of light, heat, humidity, moisture, dirt, and dust.

It is a further objective of the present invention to provide an artwork preservation system that allows for expansion and contraction of framed artwork that might result from temperature changes.

It is yet another objective of the present invention to provide an artwork preservation system that includes a vent on the port to allow for some ventilation within the sealable bag to prevent growth of anaerobic bacteria.

It is still yet another objective of the present invention to provide an artwork preservation system that includes a humidity indicator to indicate a change in moisture conditions within the sealable bag.

Yet another objective of the present invention is to provide an artwork preservation system including corrugated boards to protect framed artwork from light as well as errant impacts.

It is still yet a further objective of the present invention to provide an artwork preservation system that includes a vacuum indicator placed on the sealable bag to give a visual indication of the presence or loss of vacuum within the sealable bag.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 2:
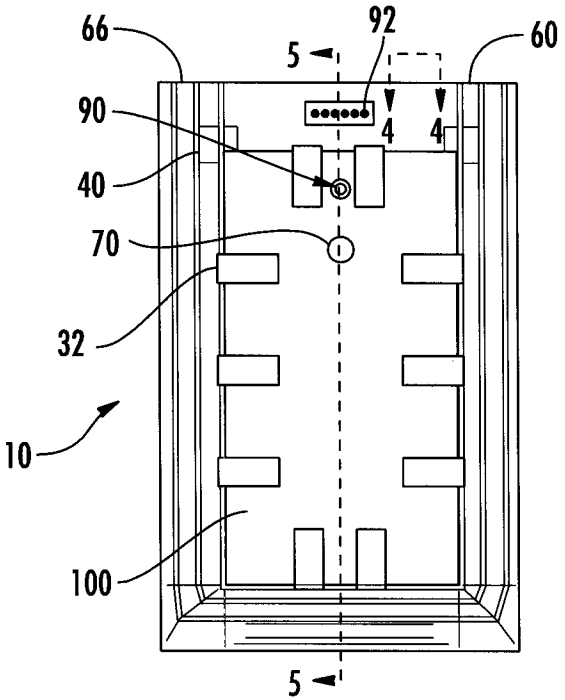
FIG. 2 is a front view of one embodiment of the present invention.
Figure 3:
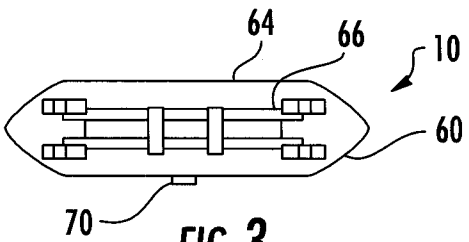
FIG. 3 is a top view of one embodiment of the artwork preservation system, illustrating the placement of a framed artwork, corrugated boards, edge and corner protectors.
Figure 1:
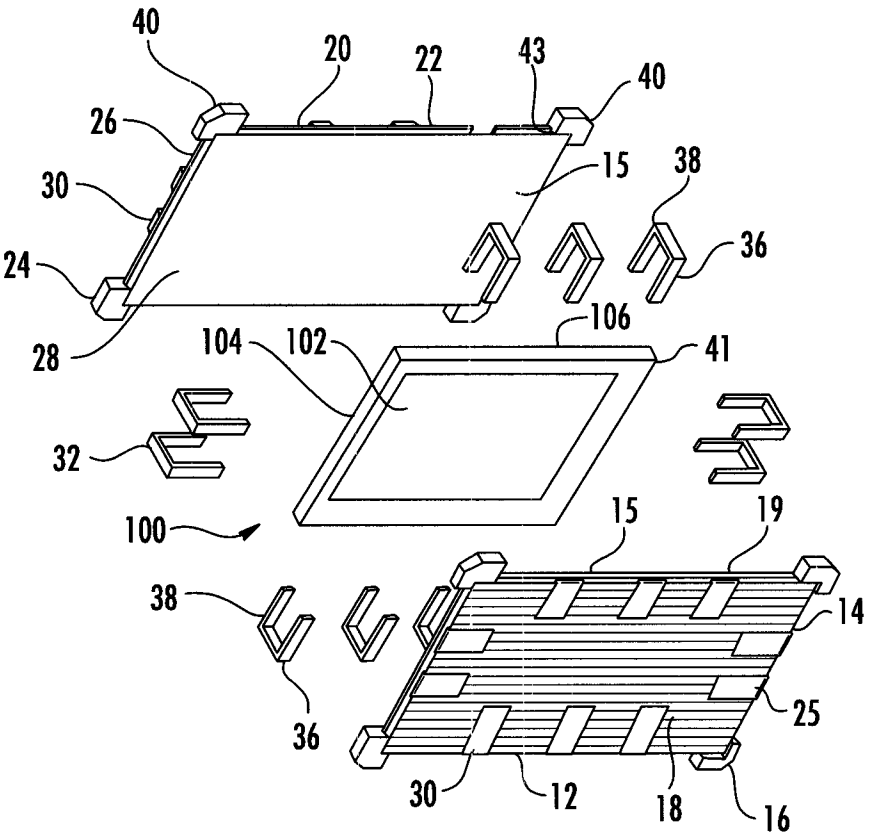
FIG. 1 is an exploded view of the present invention, illustrating the various components of the preferred embodiment, having a framed artwork therebetween.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

An artwork preservation system is disclosed. The artwork preservation system is generally constructed and arranged for use by conservators, as well as art owners, to preserve their artwork for short or long term storage and/or transport. The system provides protection against atmospheric elements such as moisture, dust, mold, insects, ultraviolet light, impacts and the like. Referring to FIGS. 1-10, the artwork preservation system 10 in part is comprised of a first corrugated board 12 constructed and arranged to overlap a front side 102 of a framed artwork 100. The first corrugated board 12 has a first edge 14 about its periphery and at least four corners 16. The first board 12 further includes a top surface 18 and a bottom surface 19. The bottom surface 19, which is in contact with the front side 102 of the artwork 100, may include a foam laminate 15, which insulates and protects the artwork 100. A second corrugated board 20 as disclosed is constructed and arranged to overlap the back side 106 of an artwork 100. The second corrugated board 20 has a second edge 22 about its periphery and at least four corners 24. The second board 20 includes a top surface 28 and bottom surface 26. The top surface 28 of the second board 20, which is in contact with the back side 106 of the artwork 100, and may include a foam laminate 15, which insulates and protects the artwork 100. Additionally, along the top surface 18 of the first edge 14 of the first board 12 are secured securement members 25 and more preferably bonded nylon loop pads 30. The loop pads are constructed and arranged to cooperate with hook straps 32 to allow the inner assembly of the artwork and the corrugated boards to be securely fastened together. The securement members 25 preferably in the form of loop pads 30 are also placed along the bottom surface 26 of the second edge 22 of the second board 20. The securement members 25 are constructed and arranged to cooperate with each other or with a secondary securement member to allow the boards to be secured in position about the artwork. In an alternative embodiment, tape or the like may be utilized in place of the first and second securement members without departing from the scope of the invention. The first and second corrugated boards, 12 and 20, are preferably constructed from a polymeric material such as plastic, however, other materials such as, but not limited to, wood, paper, rubber, metal and the like are contemplated. The C-shaped hook straps 32 cooperate with the nylon loop pads 30 on the first and second edges 14, 22 of the top and bottom surface 18, 26 of the first and second board 12, 20. The C-shaped hook strap 32 and bonded nylon loop pad 30 form a hook and loop fastener to maintain a close relationship between the first and second boards, 12 and 20, with an artwork 100 in between. Along the four corners 16 and 24 of each first and second board 12 and 20, are protective feet 40. The feet 40 are preferably L-shaped to extend around the corners 41 of the artwork and may include a channel 43 large enough to hold a first board corner 16 and a second board corner 24 in addition to the corner of the artwork 41. The feet 40 help protect the corners, 41, 16 and 24, of the artwork and boards during moving and storage. The feet 40 are constructed from an impact absorbing material, preferably from an expanded or closed cell foam material, but may be constructed from rubber, air bladders or the like without departing from the scope of the invention.

Still referring to FIGS. 1-10, a sealable bag 60 and a bubble bag 50 are disclosed. The bubble bag 50 is a secondary protective layer. The bubble bag 50 is large enough to hold the first and second boards, 12 and 20, with an artwork 100 in between, and is preferably constructed of bubble wrapping or sealed air pockets and channels. Also shown is a sealable bag 60. The sealable bag 60 has an interior surface 62, exterior surface 64, and an opening 66 large enough to accommodate the first and second corrugated boards, 12 and 20, with an artwork 100 placed in between while wrapped in the bubble bag 50, more aptly shown in FIGS. 3-6. The bag opening 66 has a zip type fastener 68 for sealing thereof; however, other sealing means such as a heating element, slider, top tape extension, top stop, pull tab, or the like can be utilized without departing from the scope of the invention. A port 70, vacuum indicator 90, and humidity indicator 92 are all part of the sealable bag 60. The port 70 is in fluid communication with the interior and exterior surface, 62 and 64, of the sealable bag 60. The humidity indicator 92 senses and readily discloses the level of humidity within the sealed bag 60. The humidity indicator 92 is a card on which a moisture-sensitive chemical is impregnated such that it will change color when the indicated relative humidity inside the sealed bag 60 is exceeded. The most common humidity indicator cards change color from blue, indicating less than relative humidity (RH) level, to pink, indicating greater than relative humidity (RH) level. The base chemical is cobalt (II) chloride, however, cobalt-free humidity indicator cards are also contemplated, as well as maximum irreversible humidity indicator cards. The vacuum indicator device 90 gives a visual indication of the presence or loss of vacuum pressure within the sealable bag 60.

Figure 4:
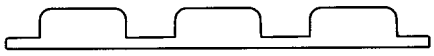
FIG. 4 is a partial section view taken along lines 4-4 of FIG. 2 illustrating an alternate embodiment of the sealable bag having air bladders incorporated therein.
Figure 5:
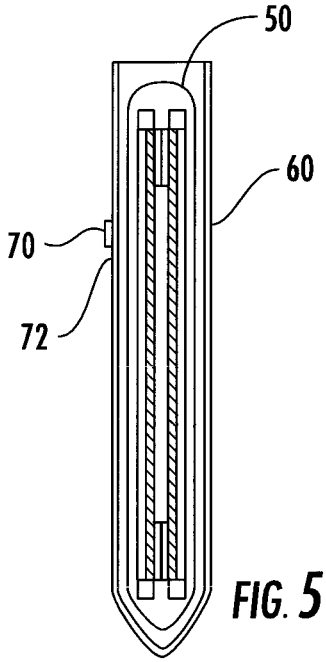
FIG. 5 is a cross-section view along lines 5-5 of FIG. 2.
Figure 6A:
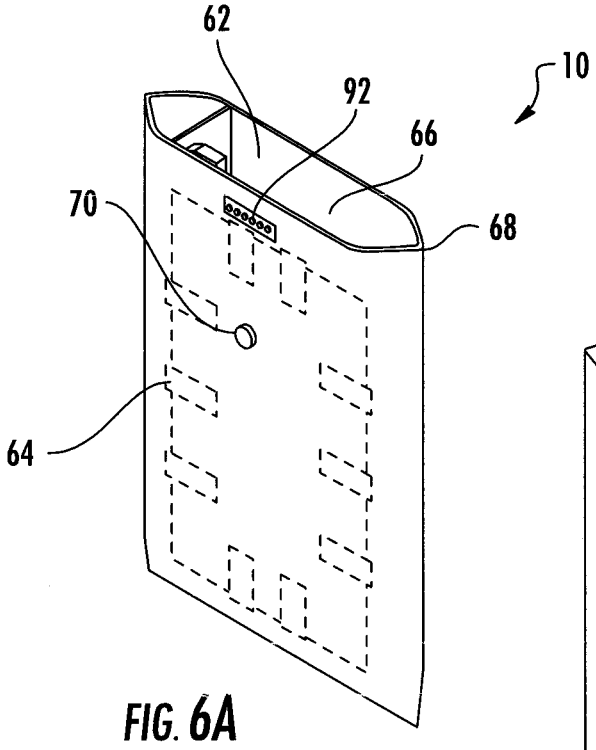
FIG. 6A is a top right perspective view of the artwork preservation system of the present invention.
Figure 6B:
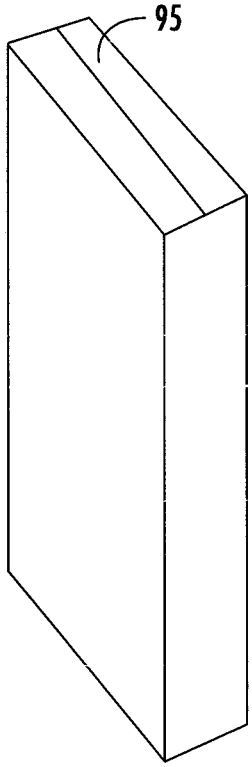
FIG. 6B is a top right perspective view of the art preservation system within a shipping box.
Figure 7:
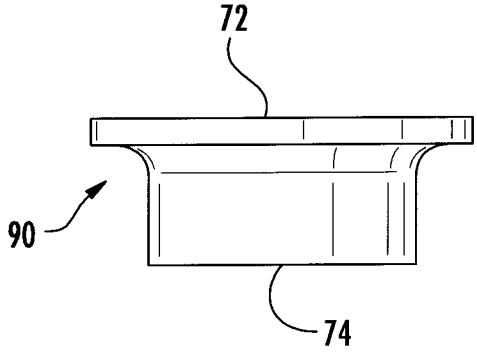
FIG. 7 is a side view of one embodiment of the vacuum port of the present invention.
Figure 8:
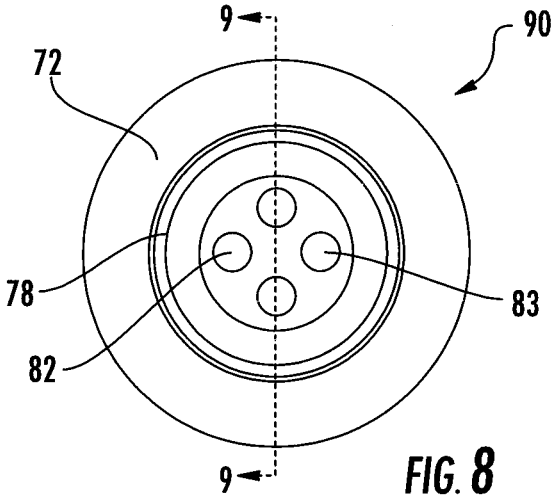
FIG. 8 is a top view of the vacuum port illustrated in FIG. 7.
Figure 9:
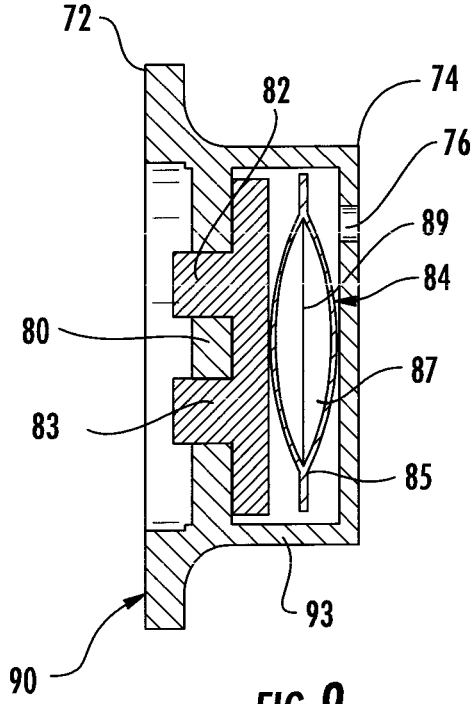
FIG. 9 is a section view taken along lines 9-9 of FIG. 8, illustrated to show when vacuum is present in the present invention.
Figure 10:
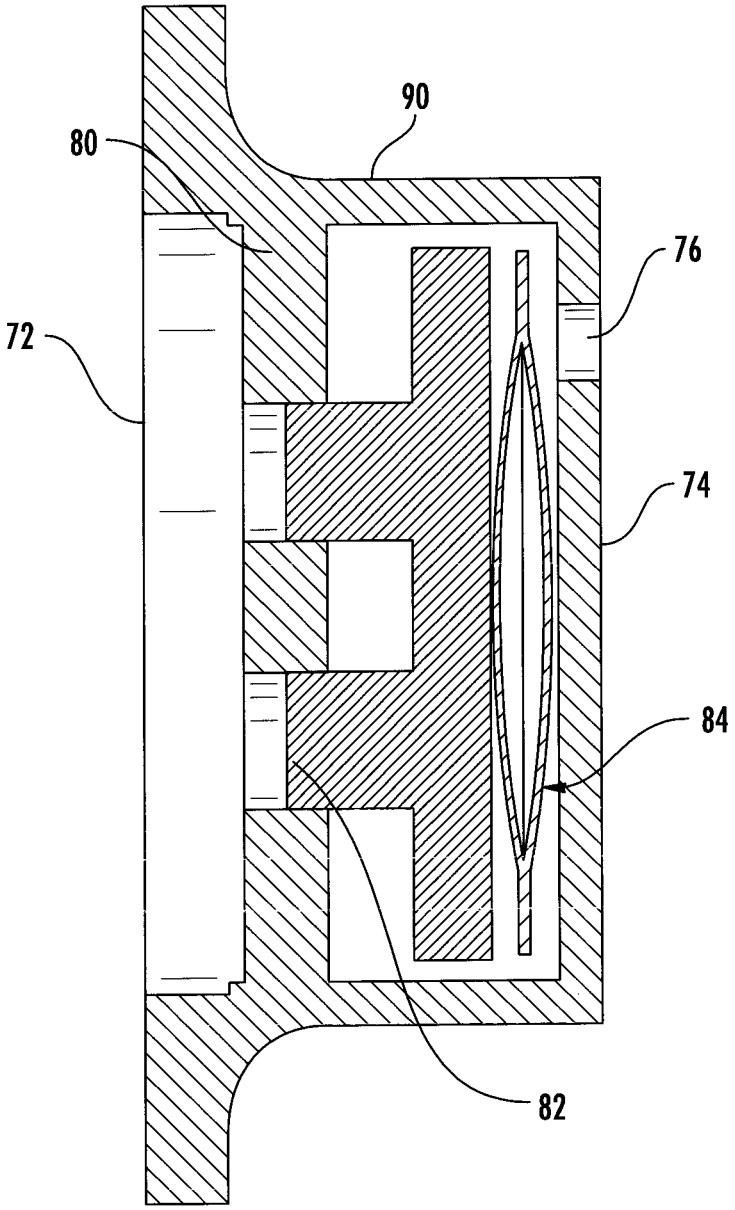
FIG. 10 is a section view taken along lines 9-9 of FIG. 8, illustrated to show when vacuum is not present.

As shown in FIGS. 4-6, the port 70, preferably includes a vacuum indicator 90 which includes an orifice 78 positioned on the outer surface of the sealable bag 60 which is operatively compatible with a hose from an external vacuum which can draw out a substantial amount of air within the interior 62 of the sealable bag 60. Alternatively, the vacuum indicated 90 may be positioned in a second port. As shown in FIGS. 7-10, the vacuum indicator 90 includes a front end 72 and a back end 74. The front end 72 includes the orifice 78, and the back end 74 includes a vent 76. The orifice 78 is constructed and arranged to receive an external vacuum hose for drawing out atmospheric pressure within the sealable bag 60. Alternatively, when no vacuum is desired, the vent 76 functions to allow for proper ventilation within the sealable bag 60, enabling for the artwork 100 to "breathe", and helps eliminate the possibility of anaerobic bacteria growing within. Also shown in FIGS. 9 and 10, the front end 72 of the vacuum indicator 90 includes a guide plate 80 and guide pins 82, and the back end 74 preferably includes a flexible member 85 in the form of an expandable bladder 84. The expandable bladder 84 is preferably formed from a pair of flexible members 85 sealed together around the perimeter thereof with a predetermined volume of gas 87 therebetween. As shown in FIG. 9, the bladder 84 expands under vacuum pressure and contracts under pressure, forcing the visual indicator 83 in the form of guide pins 82 to extend towards the front end 72 of the vacuum indicator to extend through the guide plate 80 while moving a sealing member 93 into a position against the guide plate 80, forming an airtight seal within the sealable bag 60. Additionally, when the guide pins 82 extend through the guide plate 80 they provide a visual indicator 83 that an air vacuum is present within the sealable bag 60; and likewise when the guide pins 82 drop below the surface of the guide plate 80, it provides a visual indication of the loss of a vacuum or pressure within the sealable bag 60, as shown in FIG. 10. It should also be noted that while the vacuum indicator is illustrated as including the guide pins as visual indicators, other types of visual indicators known in the art may be utilized without departing from the scope of the invention. Such visual indicators may include, but should not be limited to LEDs, rotary displays, analog gages, digital gages, bar gauges and the like. It should also be noted that a bladder is illustrated; however, other types of vacuum gauge mechanics may be utilized including, but not limited to diaphragms, piezos and the like. A shipping box or container 95 may be utilized to contain the sealable bag and all of the components of the artwork preservation system 10 for shipment through traditional shipping channels. It is also contemplated that the art preservation system be supplied with a vacuum pump which may be electric or manual in nature.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out its objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which is encompassed within the spirit of the invention and defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A framed artwork preservation system comprising:

a first board constructed and arranged to overlap a front side of a framed artwork, said first board includes a first edge about its periphery and at least four corners, a top surface and a bottom surface, said bottom surface constructed and arranged for contact with said front side of said artwork, a second board is constructed and arranged to overlap the back side of an artwork, said second board includes a second edge about its periphery and at least four corners, a top surface and bottom surface, said top surface constructed and arranged for contact with said back side of said artwork, at least one securement member constructed and arranged to cooperate with said first and said second boards for securing said first and said second boards in position against said front and said back sides of said artwork, at least two feet members constructed and arranged to cooperate with the corner portions of the artwork, said feet members being constructed from an impact absorbing material, a sealable bag, said sealable bag having an interior surface, exterior surface, and an opening large enough to accommodate said first and said second boards, with an artwork placed in between, said bag opening having a means for sealing the opening, a port in fluid communication with the interior and exterior surface of the sealable bag for removing air therefrom whereby a vacuum may be maintained within said sealable bag for storage of said framed artwork.

2. The framed artwork preservation system of claim 1 including a bubble bag, said bubble bag sized to contain said first and said second boards, with said framed artwork in between, said bubble bag also sized to fit within said sealable bag, said bubble bag including a plurality of sealed air pockets sized and shaped to absorb impact forces of a predetermined magnitude.

3. The framed artwork preservation system of claim 1 including a vacuum indicator which includes an orifice positioned on the outer surface of the sealable bag which is operatively compatible with a hose from an external vacuum source which can draw out a substantial amount of air within the interior of the sealable bag.

4. The framed artwork preservation system of claim 3 wherein said vacuum indicator includes a front end and a back end, said front end including said orifice, and said back end including a vent, said vacuum indicator including at least one flexible member, said flexible member changing shape when subjected to a vacuum condition within said sealable bag to create a visual indicator of said vacuum condition within said sealable bag.

5. The framed artwork preservation system of claim 4 wherein said flexible member moves a sealing member in response to said vacuum condition to maintain said vacuum condition after disconnection from a vacuum source.

6. The framed artwork preservation system of claim 4 wherein said flexible member is an expandable bladder.

7. The framed artwork preservation system of claim 6 wherein said expandable bladder is constructed from two members sealed together around the perimeter thereof with a predetermined volume of gas therebetween, whereby said gas expands upon subjecting said bladder to vacuum causing said bladder to expand and said gas is compressed upon subjecting said bladder to pressure causing said bladder to contract.

8. The framed artwork preservation system of claim 7 wherein said front end of said vacuum indicator includes a guide plate and guide pins, said guide pins constructed and arranged to move with said bladder to provide said visual indicator.

9. The framed artwork preservation system of claim 7 wherein said front end of said vacuum indicator includes a guide plate and guide pins, said guide pins constructed and arranged to move with said bladder to provide an air tight seal between said guide plate and said guide pins when said bladder is in an expanded condition.

10. The framed artwork preservation system of claim 9 wherein said guide pins cooperate with said guide plate to create an air vent when said bladder is in a contracted condition.

11. The framed artwork preservation system of claim 1 including four feet members, each of said feet members including a channel, said channel being large enough to hold a first board corner and a second board corner in addition to the corner of the artwork.

12. The framed artwork preservation system of claim 11 wherein said feet are constructed from an expanded polymeric material.

13. The framed artwork preservation system of claim 1 further including a box, said box sized to enclose said framed artwork preservation system for shipment or storage thereof, said box constructed from a substantially opaque material to prevent the ingress of light.

* * * * *